US005145036A

United States Patent [19]

Omalia

[11] Patent Number: 5,145,036

[45] Date of Patent: Sep. 8, 1992

[54] SELF CONTROLLED SAFETY DESCENT RETARDER

[76] Inventor: Michael Omalia, 1855 Diamond St. #5-122, San Diego, Calif. 92109

[21] Appl. No.: 699,306

[22] Filed: Apr. 11, 1991

[51] Int. Cl.[5] ..... A62B 1/14

[52] U.S. Cl. ..... 188/65.5; 182/72; 182/193

[58] Field of Search ..... 24/115 G, 136 R, 171, 24/194, 196; 182/5-7, 71-72, 100, 189-193; 188/65.1-65.5

[56] References Cited

U.S. PATENT DOCUMENTS

| | | | |
|---|---|---|---|
| 194,507 | 8/1877 | Van Wie | 188/65.4 |
| 285,603 | 9/1883 | Fell | 188/65.3 |
| 368,075 | 8/1887 | Diss | 182/72 |
| 1,114,392 | 10/1914 | Shuart | 182/193 |
| 3,217,840 | 11/1965 | Holkesvick | 188/65.4 |
| 3,739,875 | 6/1973 | Clark | 188/65.4 X |
| 4,114,726 | 9/1978 | Sentinella | 188/65.5 X |
| 4,223,761 | 9/1980 | Sennberger | 182/5 |
| 4,311,218 | 1/1982 | Steffen | 188/65.4 |
| 4,550,801 | 11/1985 | Forrest | 182/7 |
| 4,679,654 | 7/1987 | Lu | 182/5 |
| 4,702,348 | 10/1987 | Lew et al. | 182/5 X |
| 4,934,484 | 6/1990 | Green et al. | 182/5 |

FOREIGN PATENT DOCUMENTS

| | | | |
|---|---|---|---|
| 58882 | 5/1889 | Fed. Rep. of Germany | 182/193 |

*Primary Examiner*—Robert J. Oberleitner
*Assistant Examiner*—Alfred Muratori

[57] ABSTRACT

A new and improved descent retarding device having a main U shaped steel frame (7) allowing a short, light, design. There are five aluminum or steel cross bars (3) (4) (5) which act as friction retarders when the 7/16" rope (8) is attached. Two of the friction bars (4) are slotted on one end. This allows them to swing open when loading. The rope (8) slips through the space unoccupied by the open bars. The rope (8) is placed around the bars which are then pulled closed, contacting the friction bars (4) with the main frame (7). The device is now tight and ready to use. The unique combination of springs (9), handle bar (5) and adjustable self locking wing nuts (6) working in conjunction with each other make a safe, easy to use new concept in descenders. Using a handle instead of holding the rope on the descender increases balance and prevent burns. Two coil springs installed covering the main steel rod (7) at the base of the device compress and expand in response to pressure on the safety handle (5) with your hands. These reactions in the springs increase and decrease the pressure between the upper bars allowing various degrees of descent on the rope. In an emergency out of control situation these springs expand and automatically bring the user to a safe stop. By turning the adjustable wing nuts (6) up or down a fine tuning of the pressure on the friction bars can be controlled.

1 Claim, 1 Drawing Sheet

SELF CONTROLLED SAFETY DESCENT RETARDER

BACKGROUND

1. Field of Invention

This invention relates to rope descenders, specifically to a pressure sensitive device which would allow a first time user in an emergency situation a safe descent to the ground.

2. Prior Art

Inventors have been introducing fire escape descent devices since the late 1800's when buildings began exceeding the heights of personal comfort. Considering the fact that an extremely small number of these devices are ever used for the purpose in which they were intended, the general public's interest is limited in this product. Since the 1950's this type of device has been reborn, and is now generally associated with rock climbers and high-rise window cleaners.

I have personally experienced a wide range of descent devices which are used in climbing and window cleaning. Climbers are constantly experiencing falls and injury from out of control descent speeds. Window cleaning customers who live and work in high-rise buildings have for many years expressed a fire safety concern for a system anyone could use in an emergency situation.

The inventions I have located in searching the prior art do allow descent, but without safety, confidence and ease of use. Without instilling these three factors into the mind of the intended user most people will refrain from using any descent device. My descent device has the ability to satisfy these conditions.

Thereafter inventors have created many types of descent retarding devices of which the most closely related being U.S. Pat. No. 4,311,218 to Steffen 1980. The failure of this device to incorporate handles, leaves the user no option but to hold onto the rope while descending. Letting the rope slide through your hands can easily cause burns, and loss of control. Should loss of control occur, this device has no means of automatically arresting a fall.

One of the newer patents issued, U.S. Pat. No. 4,934,484 to Green 1989 is very clearly too complicated to install in an emergency, leaving the user afraid to hand from a device that might not be rigged properly. Having a cover also hinders undoing a snag in the rope that sometimes occurs, leaving you in worse shape than when you started.

Very large devices U.S. Pat. No. 4,679,654 issued to Lu 1986 have always been shunned by rescue workers. The ability to maneuver through small spaces is a common situation. The weight and material of the device will be a concern to anyone having to climb to an emergency situation. The cost of this descender would not make it competitive with others on the market.

All of the descenders and similar devices heretofore known suffer from a number of disadvantages;

(a) most are not cost effective to produce
(b) they tend to be too intricate to hook up
(c) there is no emergency stopper if they get out of control
(d) feeding a rope through your hands will produce burns
(e) there are no incorporations for adjusting to different weights (f) most have no handles
(g) ropes that twist while running through most descenders also make the person suspended from this device spin.

OBJECTS AND ADVANTAGES

Several objects and advantages of the present invention are;

(a) to provide a device that is adjustable for different weights
(b) to provide a device that people will understand and easily load
(c) to make this device affordable to everyone
(d) to provide a high quality product that will be trusted
(e) to provide a device that will stop you automatically and save your life if you should lose control
(f) to provide a device with handles for additional safety.

DRAWING FIGURES

FIG 1 the correct path of the descent line through the friction bars is illustrated FIG. 2 single hole-single slotted friction bar swings like a hinge to facilitate easy loading of rope.

DETAILED DESCRIPTION OF INVENTION

Figure 1:
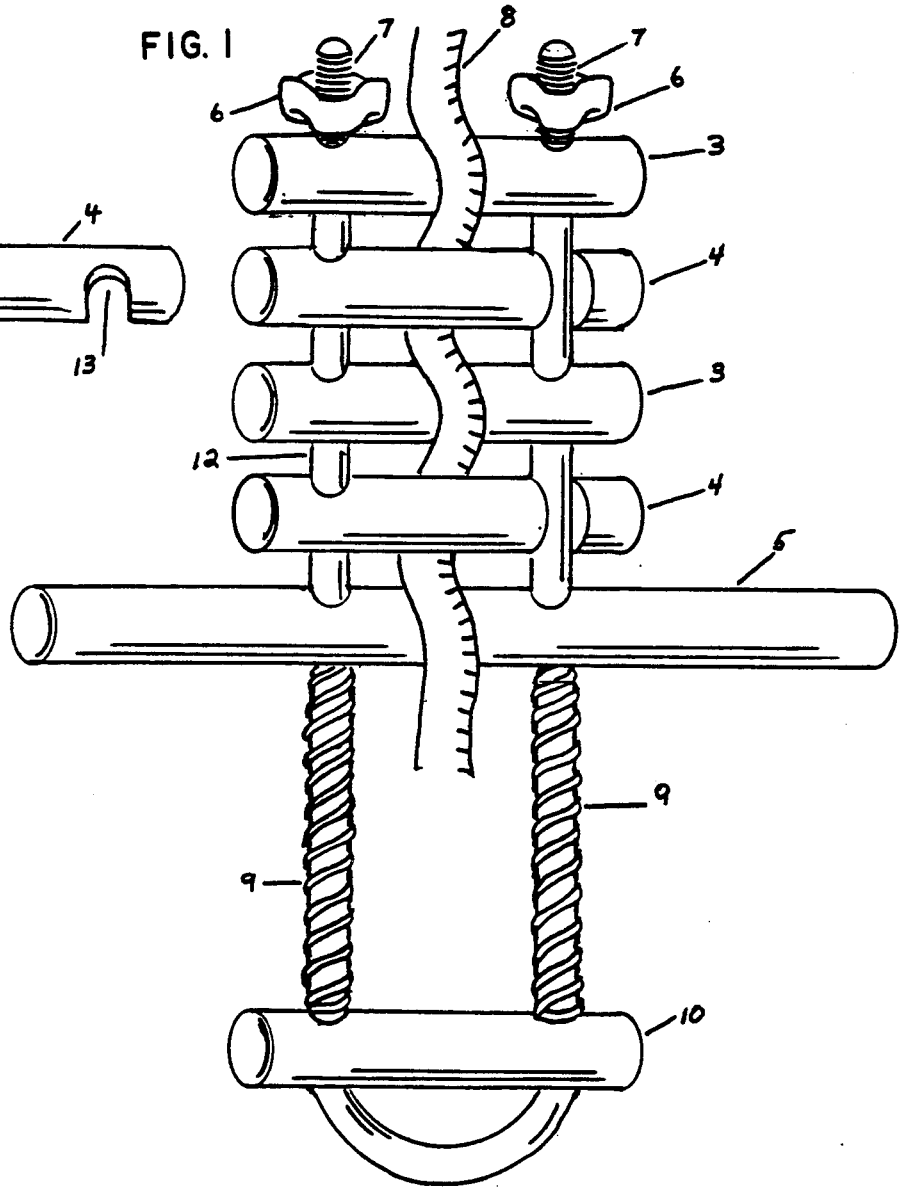

In FIG. 1 my descent device shows the correct method of installing the descent line in the device. A 7/16"climbing rope works very well. Notice how the rope winds over the rear of friction bars (4). This rope pressure when the line is taught keeps bars (4) tightly closed against main steel rod (7).

The self locking wing nuts are tightened on the steel bar (7) on the top end of this device. Their function is to hold the top friction bar level, which in turn keeps the entire device level. They can also be adjusted up or down, creating more or less friction while you are on the rope, helping to control descent speed and stopping ability.

Members 3 are two ¾" friction bars, each 3" long.

Members 4 are two friction bars that attach to main bar (7) at only one point and open on the opposite end, for the purpose of loading the descent line quickly and easily.

Figure 2:
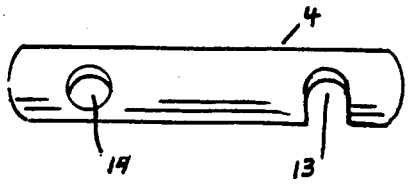

FIG. 2 is a top view of bar (4). These two opening bars allow the device to be installed anywhere along an existing rope line.

Member 5 is the handle bar which acts as a friction bar, and rests on top of the two springs. It is 8" long and ¾" in diameter. It is probably that this bar will be fitted with a rubber type coating to insure a secure grip with your hands.

Members (9) are two springs which cover the main support bar (7). They are 3" long and a key part in the unique design of this patent. It is possible to incorporate a heavy duty spring with more tension for a very heavy person and a light tension spring for a very thin person or child.

Member (10) is equal in dimension to bars (3) and (4) whose basic function is to keep the springs equally distanced from the base of the descent device. This bar does not create any added friction.

The main support rod is ⅜" steel, threaded on both ends running through and contacting all parts, formed in the shape on an elongated-U.

A steel ring at the lower most part of the device connects the device to a safety harness.

OPERATION OF INVENTION

The first step in using the device is to load the rope correctly. Hold the device in front of you so that the slotted bars (4) swing downward away from the device. Holding the device in one hand, use the other hand to feed a small rope loop through the top slot between the bars (3) and around the slotted bar (4) pulling the slotted bar back in contact with the main steel rod (7). Repeat this process between the lower bar (3) and the handle. The device is now ready to use.

After securing the main descent line (8) to a safe location, the other end of the line is lowered to the ground. You are now ready to attach yourself via a safety harness to the descender with a steel locking ring. While facing the wall you now lower your weight onto the rope. This invention is unique from most in that it will not descend immediately. A conscious effort must be made to engage the device when you are comfortable with position you are now in. A person in fear will use only slight downward pressure and descend very slowly. A person in a hurry can exert more pressure on the handle, compressing the springs and widening the space between the friction bars, allowing a speedy descent. If any time and for any reason the handle is released the descender safely stops you at that point. If at any point on the rope you try to stop, but can still feel yourself slipping, simply tighten the two wing nuts (6) in a clockwise motion to the point that the slipping stops. Upon reaching the ground disconnect from the device using the locking ring. With no pressure on the rope (8) you can easily disconnect the descender by putting slight pressure on the friction bars (4). Push them downward away from the main steel rod (7) and pulling the looped rope out.

SUMMARY—RAMIFICATIONS—SCOPE

Thus the reader will see that the descent device which we have presented incorporates safety, economy and usefulness. Combining these ideas into a new product is sure to expand the scope of its usefulness.

Besides a fire escape device, we have also seen interest in the rescue field, construction trade and climbing enthusiasts. Interest is appreciated in a product that uses quality materials and expert craftsmanship.

It is compact, light weight and easy to carry.

It is less expensive than most other similar devices.

It loads and unloads easier than other devices.

The automatic stopping action induced by the springs and the adjustable tension by the wing nuts afford those who know similar products an added dimension.

The description above contains many specificities. These should not be construed as limiting the scope of this invention but as merely providing illustrations of some of the presently preferred embodiments of this invention. The scope of this invention should be determined by the appended claims and their legal equivalents, rather than by the examples given.

I claim:

1. A controlled descent retarding device to allow a user to control their descent by using friction to either regulate the speed or stop a rope line from passing through it, comprising:

an elongate U-shaped bar with two longitudinal side members, one end of the U being open and an opposite load bearing end of the U being closed;

a plurality of movable cross bars, each having a through bore at one end for receiving one of said two side members, and each cross bar, at a second end having a slot for receiving the other of said two side members;

an elongate cross bar used as a handle bar by said user, said elongate bar having two through bores for receiving both of said two side members;

two coil springs, one on each side member between the load bearing end and the elongate cross bar;

wherein, the rope line is guided through the cross bars in a serpentine manner, and is also guided between one of said plurality of cross bars and said elongate cross bar such that, the user can one of, move the elongate cross bar, against a force exerted by the coil springs, away from said one of the plurality of cross bars to reduce the friction on the rope line thus increasing the speed of descent, or the user can allow the force of the coil springs to move the elongate cross bar closer to said one of the plurality of cross bars to increase the friction on the rope line to one of decreasing the speed of or stopping the descent.

* * * * *